US006923695B2

(12) United States Patent
Ide et al.

(10) Patent No.: US 6,923,695 B2
(45) Date of Patent: Aug. 2, 2005

(54) OUTBOARD MOTOR

(75) Inventors: Shinichi Ide, Wako (JP); Makoto Yazaki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/839,510

(22) Filed: May 5, 2004

(65) Prior Publication Data

US 2004/0226737 A1 Nov. 18, 2004

(30) Foreign Application Priority Data

May 13, 2003 (JP) ..... 2003-135083

(51) Int. Cl.[7] ..... B63H 20/32
(52) U.S. Cl. ..... 440/77
(58) Field of Search ..... 440/76, 77

(56) References Cited

U.S. PATENT DOCUMENTS 4,533,331 A * 8/1985 Bland ..... 440/77
4,969,847 A * 11/1990 Curtis et al. ..... 440/77
5,637,021 A 6/1997 Watanabe ..... 440/77
6,183,322 B1 2/2001 Takahashi ..... 440/76

FOREIGN PATENT DOCUMENTS

JP 01039390 2/2001

* cited by examiner

*Primary Examiner*—Stephen Avila
(74) *Attorney, Agent, or Firm*—Adams & Wilks

(57) ABSTRACT

An outboard motor has an engine and a cover structure comprised of first and second cover members detachably connected to one another to define at least part of an engine compartment accommodating therein at least a portion of the engine. A cover body is mounted on the cover structure and has a tubular portion with an open end through which cables are introduced into the engine compartment. A sealing member extends into the tubular portion of the cover body through the open end for retaining in a sealed state the cables introduced into the engine compartment. The sealing member has an outer peripheral surface and elastically deformable lip portions extending from the outer peripheral surface and contacting an inner peripheral surface of the tubular portion in the region of the open to form a hermetic seal between the lip portions and the inner peripheral surface of the tubular portion.

20 Claims, 7 Drawing Sheets

OUTBOARD MOTOR

FIELD OF THE INVENTION

The present invention relates to outboard motors, and more particularly, to a cover structure for introducing cables into an engine compartment.

BACKGROUND OF THE INVENTION

A cover constituting the appearance of an outboard motor is generally made from an aluminum alloy to provide required rigidity to the outboard motor to be supported on a stern of a boat.

In some outboard motors, however, a cover made from a resin material is in practical use to reduce weight and cost. For example, an engine cover forming an upper half of an engine compartment and an under cover forming a lower half of the engine compartment are made from resin.

Into the engine compartment defined by a cover body consisting of the engine cover and the under cover, cables including an engine control cable for opening and closing a throttle valve, a power train control cable for switching between forward and rearward propulsion, a power supply cable, a various electrical signal transmission cable and a fuel feeding pipe are introduced.

An introduction portion for the cables is provided in the cover body. A sealing member is provided around the introduction portion and the cables to prevent ingress of water into the engine compartment.

An outboard motor having such kind of sealing structure is disclosed, for example, in Japanese Patent Laid-Open Publication No. 2001-39390.

An under cover of the outboard motor is divided into left and right portions. A right cover of the left and right divisions is formed with a horizontally notched portion in a substantially U shape. A front cover joined to the right cover is formed with a horizontally extending protruded portion fitted into the notched portion.

When the notched portion and the protruded portion are fitted together, a circular retention opening is formed between the deepest portion of the notched portion and the distal end of the protruded portion. A cable holding member made from an elastic material such as rubber is fitted into the retention opening. That is, the cable holding member is held between the notched portion and the protruded portion in a sandwiched manner. Cables are inserted through the cable holding member and retained therein. A watertight groove is formed around the periphery of the cable holding member. A flange formed around the inner periphery of the retention opening is fitted into the watertight groove, thereby forming a sealing structure.

To improve sealing performance, it is required to form the notched portion and the protruded portion with high precision.

It is also required to fit the notched portion and the protruded portion together, restraining the expansion of the cable holding member having elasticity. In either case, care should be taken in production.

It is thus desired to improve sealing and retention of cables with a sealing member (grommet), and to facilitate mounting of a cable retention cover to a cover body with high precision.

SUMMARY OF THE INVENTION

According to an aspect of the present invention, there is provided an outboard motor, which comprises: an engine; a cover constituting at least a part of an engine compartment housing the engine; a cable introduction cover mounted to the cover, the cable introduction cover having an introduction opening through which cables including cables and pipes to be introduced into the engine compartment are inserted; and a sealing member axially held in the introduction opening of the cable introduction cover to seal and retain the cables.

As described above, the cable introduction cover is mounted to the cover, and the introduction opening opening in a fore-and-aft direction is formed in the cable introduction cover, and the sealing member for retaining the cables is inserted into the introduction opening from a fore-and-aft direction to be held therein, so that the sealing member is sealed and retained circumferentially between the cable introduction cover and the sealing member. Thus, a sealing surface continues smoothly, facilitating the provision of good sealing performance, and also resulting in good productivity. Further, the sealing member can be easily aligned with the cable introduction cover, so that the sealing member can be retained under a generally uniform pressure.

In the outboard motor of this invention, the cover is preferably divided into left and right portions; the cable introduction cover preferably has a cover body joined to the split cover and a partly tubular introduction opening provided to the cover body, opening in a forward direction of the outboard motor; and the sealing member preferably has, around a periphery thereof, a circular flexible engaging portion engaging and sealing an inner peripheral surface of the introduction opening. Consequently, the cables can be inserted and fitted into the introduction opening of the cable introduction cover, and the flexible engaging portion can provide sealing, eliminating the need to firmly press the entire sealing member.

In this invention, the inner peripheral surface of the tubular introduction opening of the cable introduction cover has an inclined surface with a diameter reduced in a forward direction, and the circular flexible engaging portion around the periphery of the sealing member constitutes a lip, a distal end portion of the lip being bent correspondingly to the inclined surface of the introduction opening for close contact, forming a seal between the periphery of the sealing member and the inner peripheral surface of the introduction opening. Thus, high sealing performance can be obtained. The sealing member is only inserted into the tubular introduction opening, thereby to be able to provide sealing by the action of the inclined surface and the lip.

BRIEF DESCRIPTION OF THE DRAWINGS

Preferred embodiments of the present invention will be described in detail below, by way of example only, with reference to the accompanying drawings, in which.

DETAILED DESCRIPTION OF THE PREFERRED EMBODIMENTS

Figure 1:
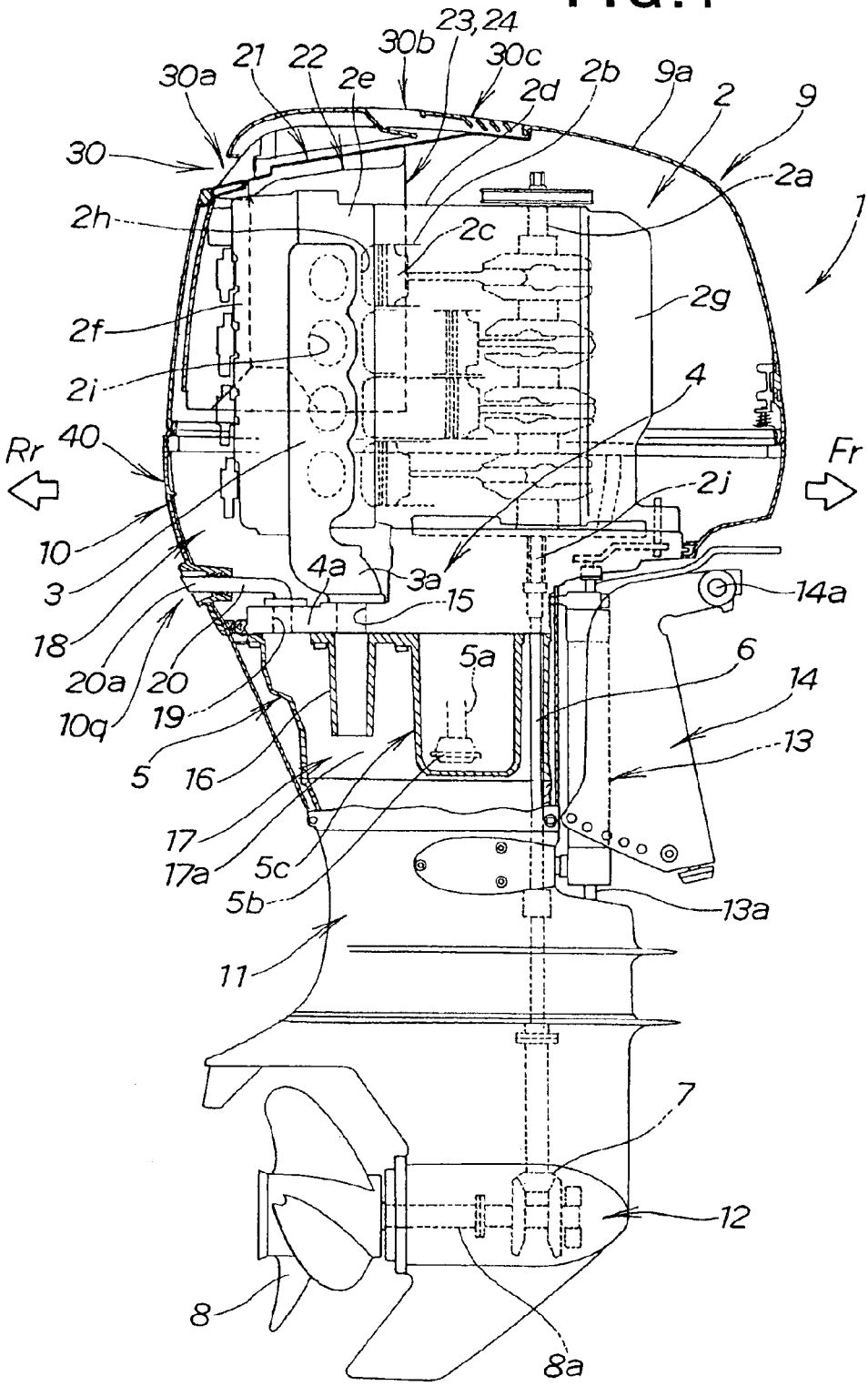
FIG. 1 is a side view, in partial cross section, of an outboard motor.

In the drawings referred to in the description below, reference signs Fr and Rr denote fore-and-aft directions of an outboard motor 1.

The outboard motor 1 shown in FIG. 1 includes a mount case 4 supporting an engine 2, and an engine cover 9 covering the engine 2 and defining an engine compartment 18.

The engine 2 is a vertical engine with a crankshaft 2*a* oriented vertically. The engine 2 is a multicylinder engine having a cylinder block 2*d* disposed in a fore and aft intermediate position in the outboard motor 1, in which multiple cylinders 2*b* (four cylinders in the embodiment) are arranged above and below in parallel.

Pistons 2*c* are provided in the cylinders 2*b*, respectively. The centerline of each cylinder 2*b* is oriented in a fore-and-aft direction of the outboard motor 1.

A cylinder head 2*e* is provided at the rear of the cylinder block 2*d*. A cylinder head cover 2*f* is provided at the rear of the cylinder head 2*e*. A crankcase 2*g* is disposed at the front of the cylinder block 2*d*. The cylinder block 2*d*, cylinder head 2*e*, cylinder head cover 2*f* and crankcase 2*g* constitute an engine assembly. The engine assembly is supported by the mount case 4 on an oil case 5. An oil pump body is provided below the engine 2.

Combustion chambers 2*h* of the engine 2 are formed by the cylinders 2*b*, pistons 2*c* and cylinder head 2*e*.

The combustion chambers 2*h* communicate with exhaust ports 2*i* provided in the cylinder head 2*e*, respectively. An exhaust manifold 3 is provided vertically, laterally outside the cylinder head 2*e* so as to correspond to the exhaust ports 2*i*.

The oil case 5 has an oil pan 5*c* and an exhaust chamber 17*a* to be described below. An oil suction pipe 5*a* and an oil strainer 5*b* are housed in the oil pan 5*c*. The mount case 4 serves as a partition between the engine compartment 18 and a chamber 17 located below.

The crankshaft 2*a* is located in a forward portion of the outboard motor 1 on the right in FIG. 1.

A lower end portion of the crankshaft 2*a* is connected to an output shaft 2*j* via a flywheel not shown. The output shaft 2*j* vertically passes through the mount case 4 and is connected to an upper end portion of a drive shaft 6 coaxial with the output shaft 2*j*.

The drive shaft 6 extends vertically downward through and between the oil pan 5*c* and the oil case 5 to be out to rotationally drive an output shaft 8*a* via a transmission mechanism 7.

A propeller 8 is connected to a rear end portion of the output shaft 8*a*. The drive shaft 6 driven by the engine 2 rotates the propeller 8 via the transmission mechanism 7. A hull is propelled by the rotation of the propeller 8.

The engine cover 9 is made from a resin material and surrounds upper and peripheral portions of the engine 2. That is, the engine cover 9 covers a portion of the engine 2 above a vertically intermediate portion thereof.

A resin under cover 10 provided below the engine cover 9 covers a lower half portion of the engine 2 and the periphery of the mount case 4 housing the oil pump body.

An extension case 11 is connected to a lower portion of the oil case 5 to extend downward. The extension case 11 is formed from an aluminum alloy.

A gearbox 12 containing the transmission mechanism 17 is integrally provided to a lower portion of the extension case 11. The gearbox 12 is formed from an aluminum alloy.

The under cover 10 covers mating surfaces of the oil case 5 and the extension case 11.

The mount case 4 and surrounding portions are formed from metal such as an aluminum alloy.

A swivel shaft 13*a* is provided vertically between a front portion of the mount case 4 and a front portion of the extension case 11. The swivel shaft 13*a* is housed in a swivel case 13. A tilt shaft 14*a* supporting the outboard motor 1 in a vertically rotatable manner is provided at a stern bracket 14 connected to the swivel case 13. The stern bracket 14 is fixed to a stern. The outboard motor 1 is thus supported in a steerable and tiltable manner with respect to the stern.

An exhaust outlet 3*a* of the exhaust manifold 3 communicates with an exhaust pipe 16 integrally formed with the oil case 5 via a communicating opening 15 provided in the mount case 4. An exhaust passage is formed by the exhaust manifold 3, communicating opening 15 and exhaust pipe 16. The exhaust pipe 16 is located within the exhaust chamber 17*a*, extending downward adjacently to the rear of the oil pan 5*c*.

In a rear portion 4*a* of the mount case 4, a passage 19 communicating with the exhaust chamber 17*a* is provided. A proximal end portion of an exhaust outlet pipe 20 is connected to the passage 19 at the opposite side to the side of the exhaust chamber 17*a*. A distal end portion 20*a* of the exhaust outlet pipe 20 leads to the outside through an opening 10*q* formed in the under cover 10. That is, outside air and the exhaust chamber 17*a* communicate with one another through the passage 19 and the exhaust outlet pipe 20.

Therefore, when the exhaust pressure of the engine 2 is low, an exhaust gas is discharged through the exhaust outlet pipe 20 to the outside of the outboard motor 1. When the exhaust pressure of the engine 2 is high, an exhaust gas is discharged from the exhaust chamber 17*a* through the inside of the extension case 11 into water.

The engine cover 9 has a roof 9*a* formed with an air inlet opening 30 for taking air into the engine compartment 18. The air inlet opening 30 includes a first air inlet opening 30*a* formed in a rear portion of the roof 9*a*, a second air inlet opening 30*b* formed in a longitudinally middle portion of the roof 9*a*, and a louvered third air inlet opening 30*c* formed forward of the second air inlet opening 30*b*.

Air taken in through the air inlet openings 30, 30*a*, 30*b* and 30*c* is guided into the engine compartment 18 via an intake passage unit 21.

The intake passage unit 21 includes a connecting portion 22, and left and right two intake passage portions 23, 24 integrally formed at the left and the right of the connecting portion 22, extending downward with their lower ends located within the engine compartment 18 (FIG. 1 shows a cross section and the right intake passage portion 24 is not shown), having an inverted U shape. The left and right intake passage portions 23, 24 are located along the opposite sides of the rear of the engine 2. Air introduced through the air inlet opening 30 is guided into the engine compartment 18 through the left and right intake passage portions 23, 24 which communicate with openings formed at the left and the right of the connecting portion 22.

Figure 2:
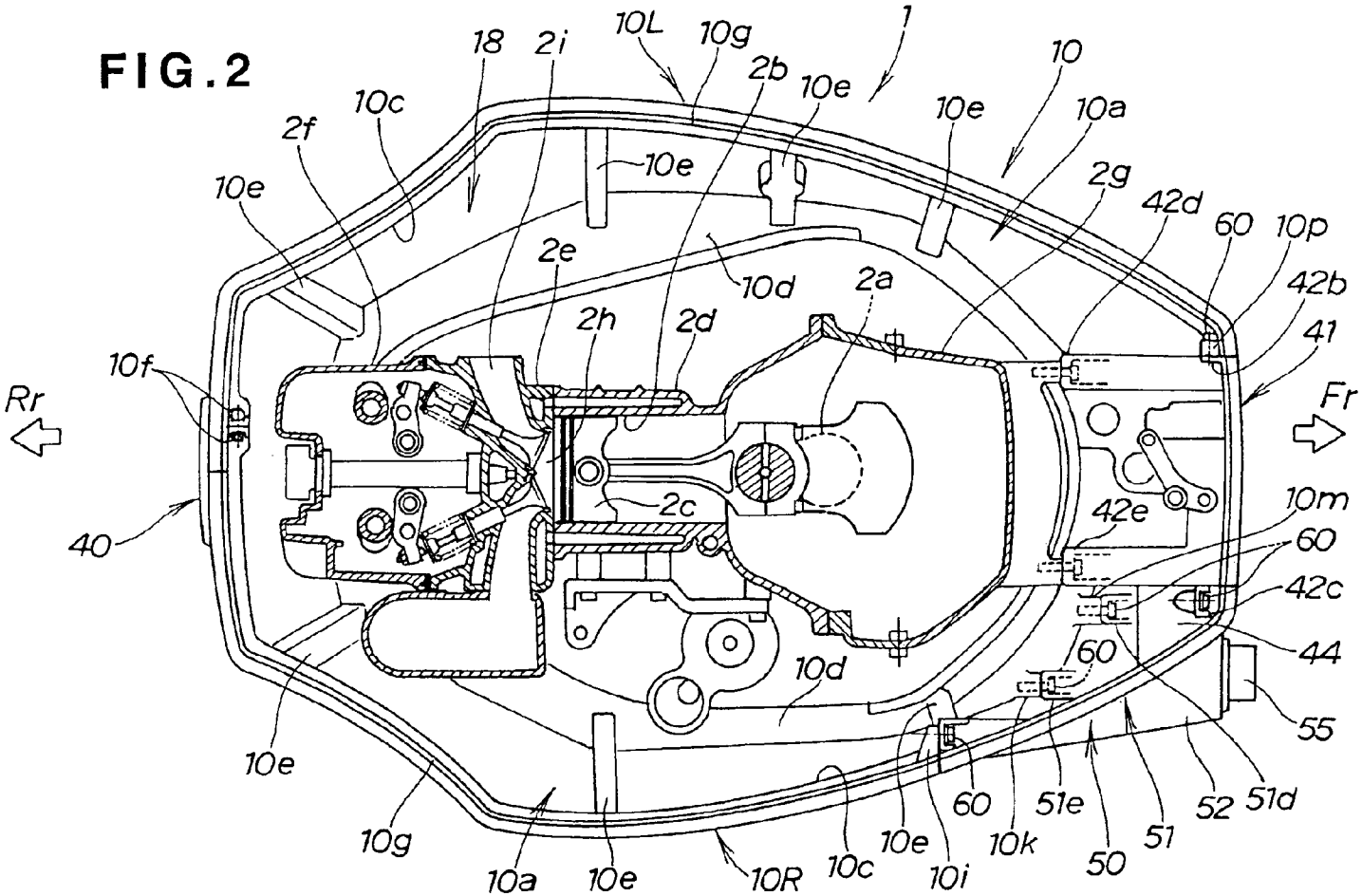
FIG. 2 is a plan view of a horizontal cross section of an engine with an engine cover removed.

FIG. 2 shows an engine in horizontal cross section with the engine cover removed.

Referring to FIG. 2, it will be understood that the engine 2 is of a vertical type with the crankshaft 2*a* oriented vertically and the cylinder axis oriented horizontally.

The under cover 10 is made from resin and is configured with first and second cover members comprising left and right split cover halves 10L, 10R joined together. The cover halves 10L, 10R form a cover structure defining at least a part of an engine space accommodating therein at least a portion of the engine.

A sealing lid 40 is attached to a rear mating surface of the joined cover halves 10L, 10R. A holding member or cable holder 41 is provided between front portions of the joined left and right cover halves 10L, 10R. A cable introduction cover 50 is joined to a front portion of the cover right half 10R.

Figure 3:
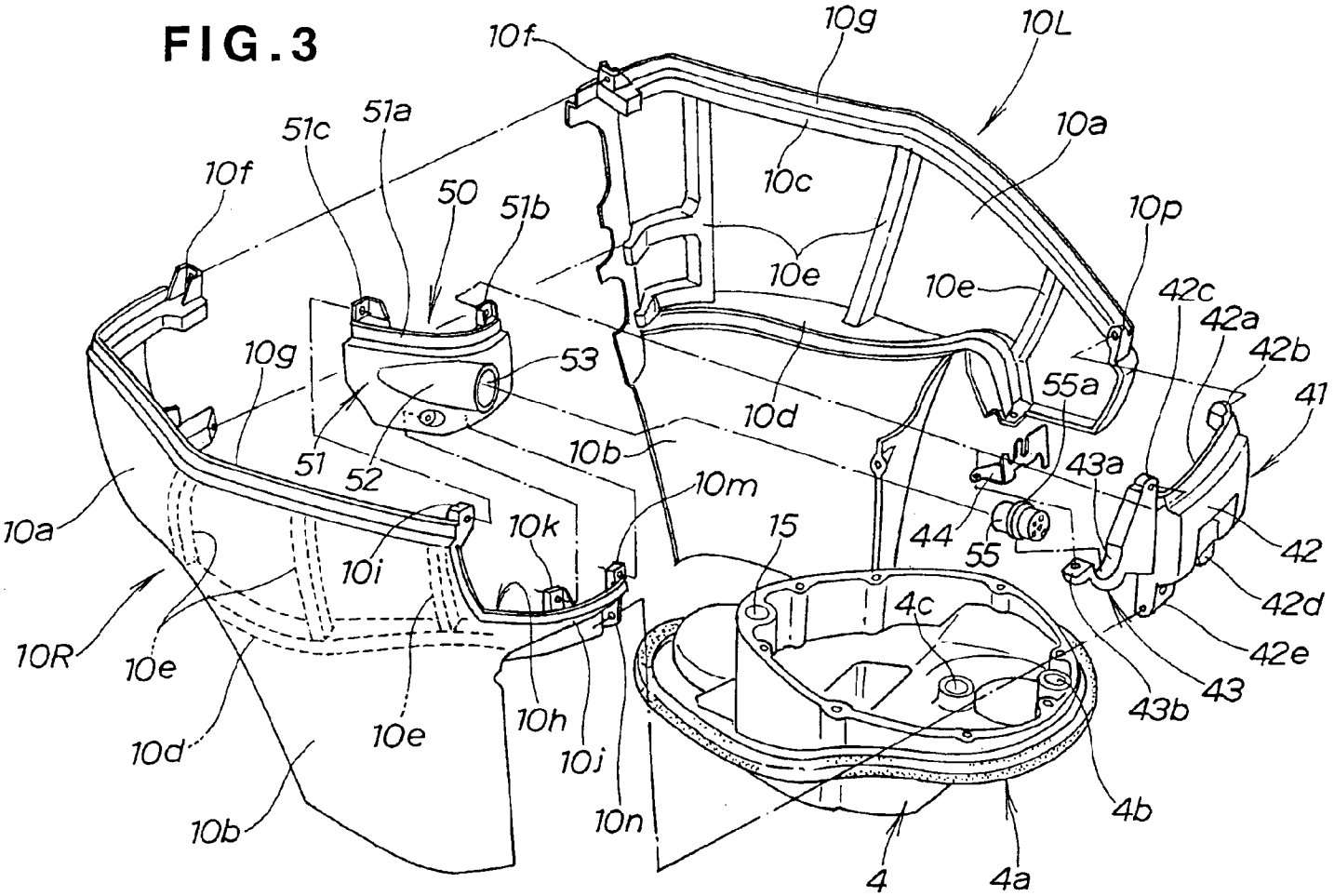
FIG. 3 is an exploded perspective view of an under cover, a mount case, a cable introduction cover and a cable holder according to the present invention.

FIG. 3 illustrates the mount case 4, under cover 10, cable holder 41 and cable introduction cover 50.

The left and right halves 10L, 10R of the under cover 10 are comprised of upper half portions 10*a*, 10*a*, and lower half portions 10*b*, 10*b*, respectively. The upper half portions 10*a*, 10*a* are fore and aft elongated and expanded outward. The lower half portions 10*b*, 10*b* have a shorter fore-and-aft length and have a downwardly narrowed shape.

The upper half portions 10*a*, 10*a* each have reinforcing horizontal ribs 10*c*, 10*d* attached to the inner surface by oscillation welding, ultrasonic welding, riveting or the like, in such a manner as to fore and aft extend, being spaced vertically. A plurality of vertical reinforcing ribs 10*e* spaced fore and aft is likewise provided between the upper and lower reinforcing ribs 10*c*, 10*d*.

The left and right cover halves 10L, 10R are provided with connected portions 10*f* at their mating portions. The connected portions 10*f* are butted and bolted together. Rib-like standing portions 10*g*, 10*g* to engage a lower edge portion of the engine cover 9 are provided along upper edge portions of the left and right cover halves 10L, 10R.

A sealing member 4*a* such as rubber having elasticity is fitted onto the periphery of the mount case 4. The mount case 4 is fitted between the lower reinforcing ribs 10*d*, 10*d* via the sealing member 4*a*.

Reference sign 4*b* denotes a support hole for supporting an upper end portion of the swivel shaft 13*a* shown in FIG. 1, and 4*c* denotes an insertion hole for the output shaft 2*j*. Reference numeral 15 denotes the communicating opening for connecting the exhaust outlet 3*a* of the exhaust manifold 3 to the exhaust pipe 16.

The cable holder 41 made from an aluminum alloy is extended between front upper portions of the left and right cover halves 10L, 10R to connect them.

The cable holder 41 has a holder body 42. The holder body 42 integrally has a standing portion 42*a* formed at its upper edge portion, connected portions 42*b*, 42*c* formed at the left and the right of the upper edge portion, and connected portions 42*d*, 42*e* formed at the left and the right of its lower portion. The cable holder 41 is fixed to the engine assembly or to the mount case 4 via the connected portions 42*d*, 42*e*.

The holder body 42 integrally has an arm 43 extended laterally outward from a right side portion. The arm 43 has in it upper portion a support depression 43*a* formed in a semicircular shape, and has at its right end portion a mounted portion 43*b* formed upward.

The right cover half 10R has a connected portion 10*i* formed at its front upper portion, and a platform portion 10J extending from its front portion forward and inward. A notch 10*h* forming a substantially L shape with the platform portion 10*j* in front and side views is formed in a front portion of the right cover half 10R. The platform portion 10*j* has two connected portions 10*k*, 10*m* formed at its upper edge portions and a connected portion 10*n* formed at its lower edge portion.

The left cover half 10L has a connected portion 10*p* formed at its front end portion.

The cable introduction cover 50 has at its upper edge portion a standing portion 51*a* corresponding to the standing portion 10*g* of the right cover half 10R and the standing portion 42*a* of the cable holder 41.

Figure 4:
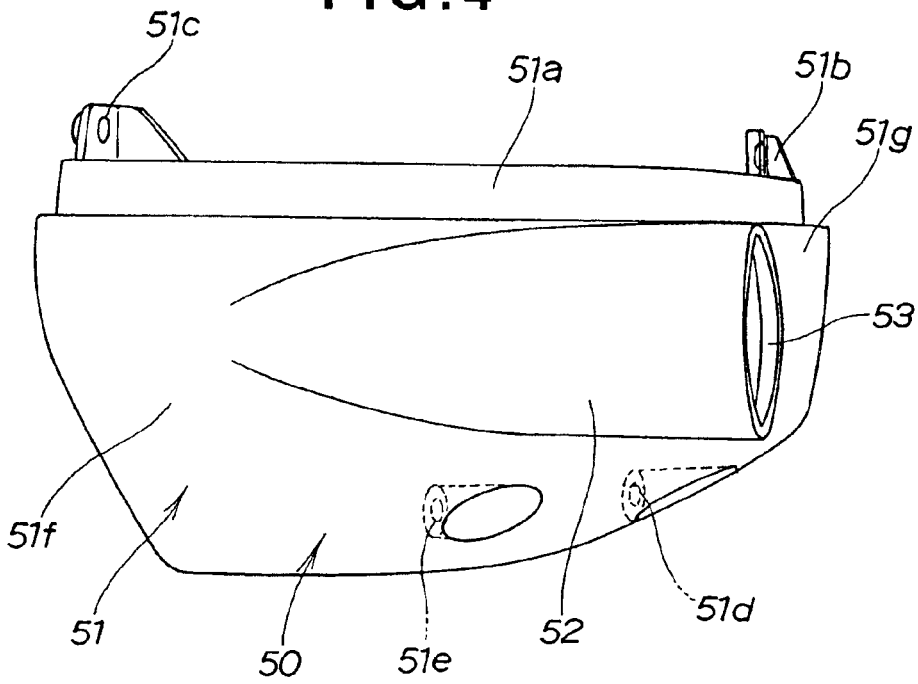
FIG. 4 is a side view of the cable introduction cover shown in FIG. 3.
Figure 5:
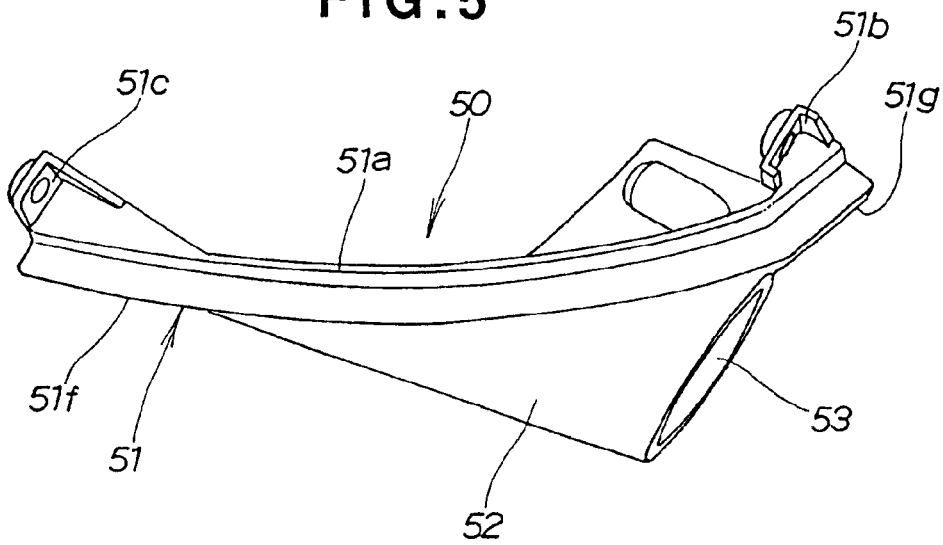
FIG. 5 is a plan view of the cable introduction cover shown in FIG. 3.

The structure of the cable introduction cover 50 is shown in detail in FIGS. 4 and 5.

The cable introduction cover 50 has a cover body 51. The cover body 51 has a side portion 51*f* and a front portion 51*g*.

The cover body 51 is, as shown in FIG. 5, curved in a plan view, having a connected portion 51*c* formed at its rear upper portion, and a connected portion 51*b* formed at the inside of its front end portion. The cover body 51 also has two connected portions 51*d*, 51*e* having through holes opening forward in its lower forward portion.

The cable introduction cover 50 has a tubular portion 52 expanded outside of the cover body 51 from a fore-and-aft intermediate portion to a front portion, having a forward opening 53 defining an introduction opening.

Figure 6:
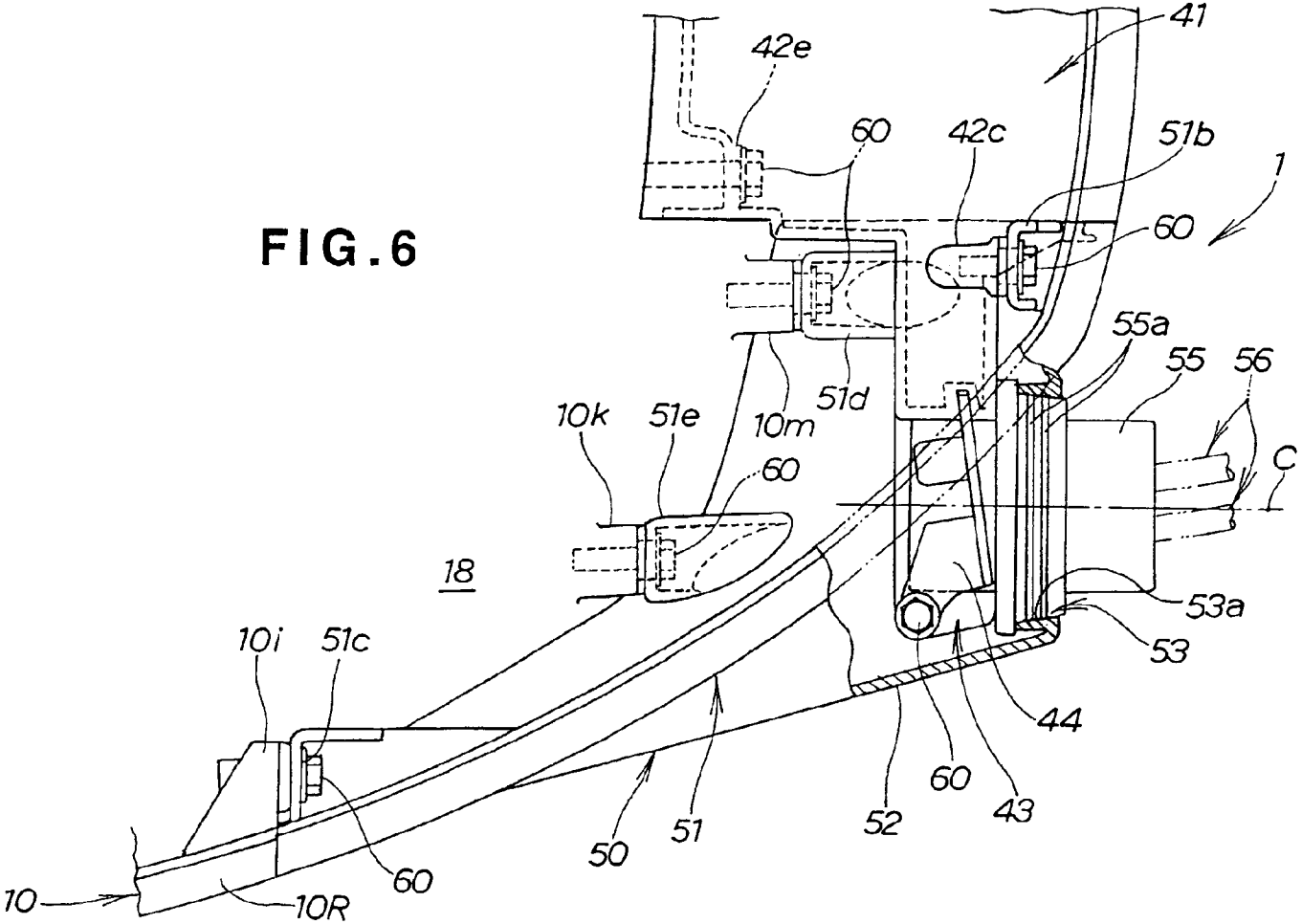
FIG. 6 is a plan view, in part in cross section, of the cable introduction cover joined to a right cover half.
Figure 7:
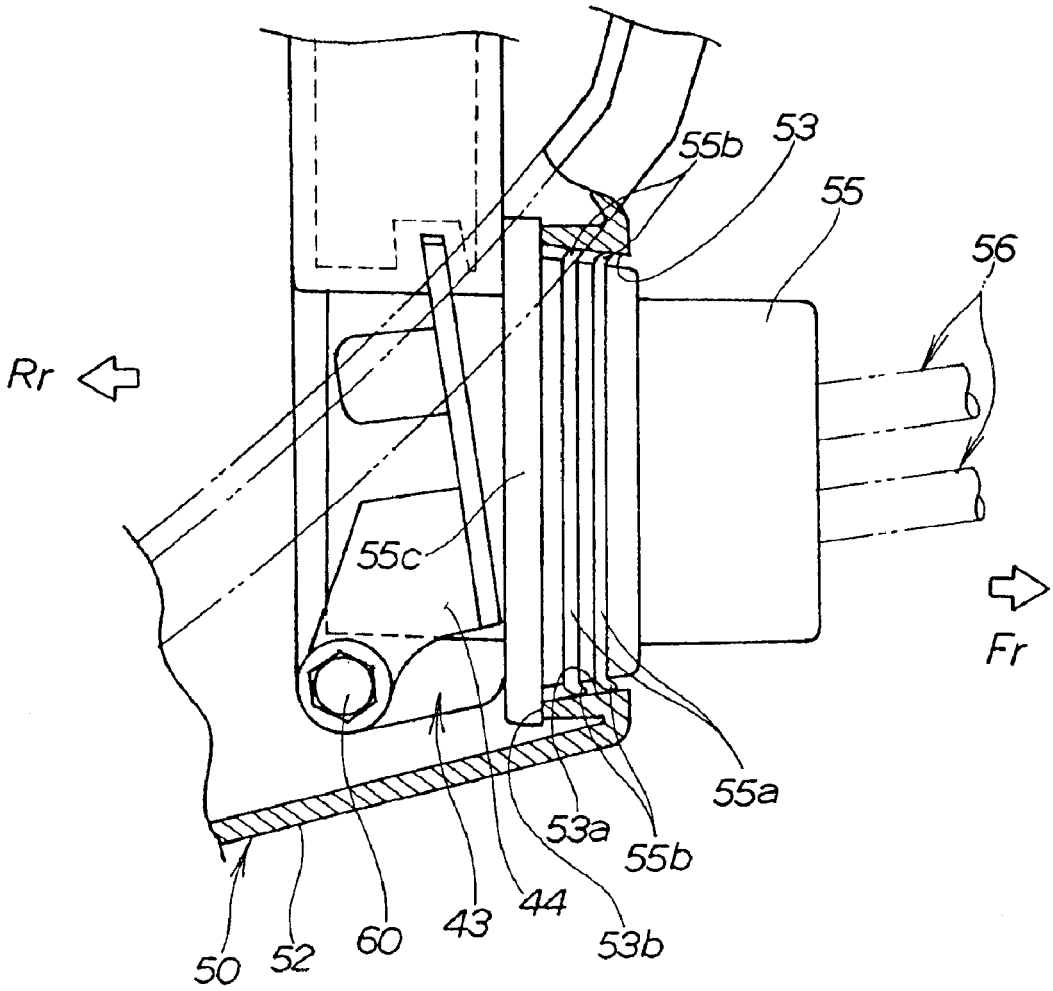
FIG. 7 is a diagram illustrating a sealing member mounted to an opening of the cable introduction cover.
Figure 8:
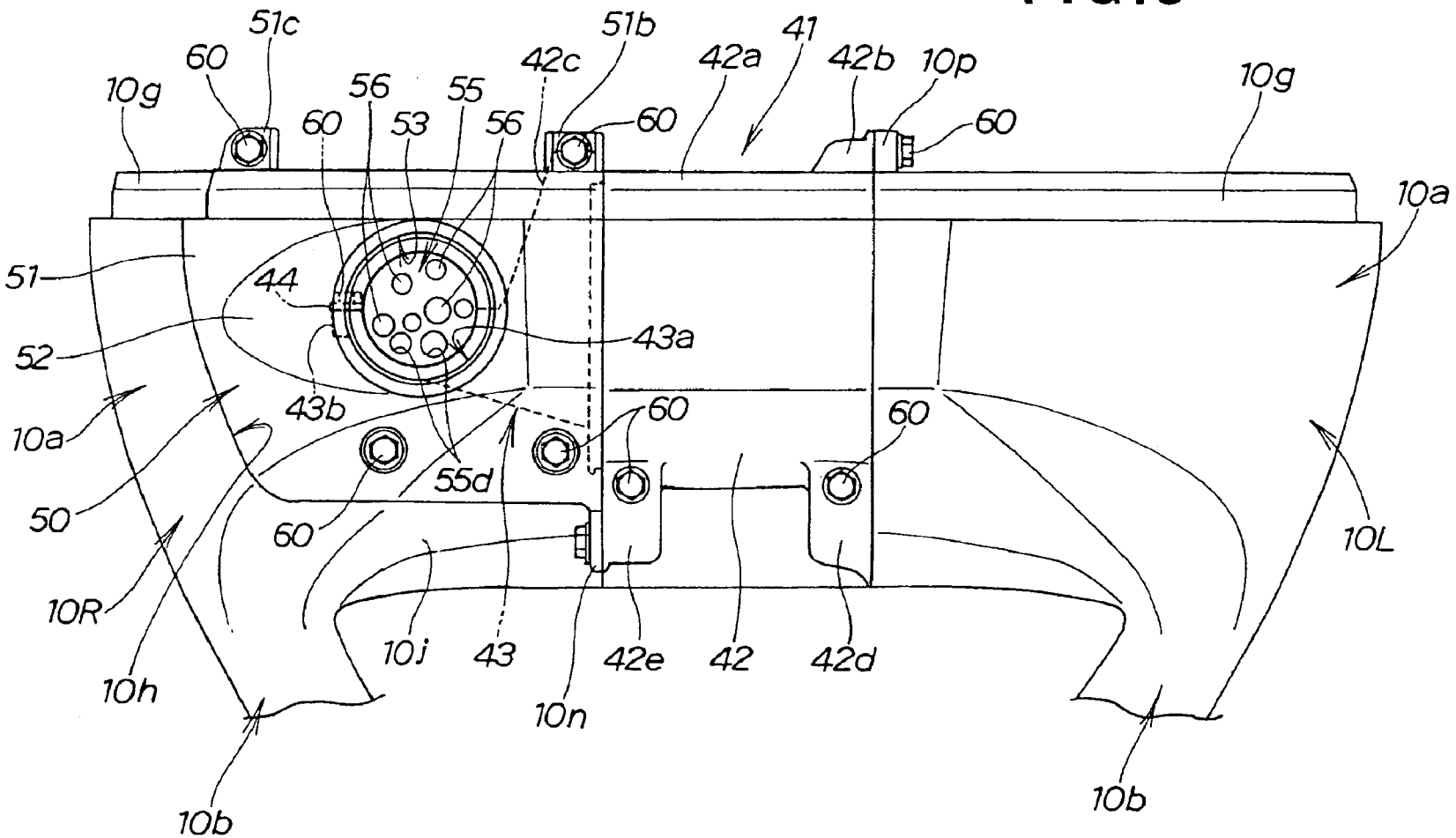
FIG. 8 is a front view of left and right cover halves joined together with the cable introduction cover and the cable holder mounted.

FIGS. 6, 7 and 8 illustrate the structure of mounting the cable introduction cover 50 and a sealing member 55 to the under cover 10.

The cable introduction cover 50 is fitted onto the notch 10*h* formed in the front portion of the right cover half 10R as shown in FIG. 8, with the connected portions 10*i*, 10*k*, 10*m* of the right cover half 10R connected to the connected portions 51*c*, 51*d*, 51*e* of the cable introduction cover 50 with bolts 60, respectively. As a result, the cable introduction cover 50 constitutes a part of a right front portion of the right cover half 10R.

The cable holder 41 is interposed between the upper portions of the left and right cover halves 10L, 10R as shown in FIG. 8. The connected portions 42*c*, 42*b* at upper left and right portions of the cable holder 41 are connected to the connected portion 51*b* of the cable introduction cover 50 and the connected portion 10*p* of the left cover half 10L with bolts 60, respectively. The connected portions 42*d*, 42*e* at lower left and right portions of the cable holder 41 are connected to the connected portion 10*n* extending downward below the platform portion 10*j* of the right cover half 10R and another portion with bolts 60. In this manner, the cable holder 41 is mounted to the left and right cover halves 10L, 10R.

Cables 56 introduced into the engine compartment 18 include an engine control cable for opening and closing a throttle valve, a powertrain control cable for switching between forward and rearward propulsion, a power supply cable, a various electrical signal transmission cable and a fuel feeding pipe. The cables 56 are inserted through a plurality of through holes 55*d* formed in and through the rubber sealing member 55 in a fore-and-aft direction, to be held in the sealing member 55 in a sealed state.

The sealing member 55 is a cylinder having the through holes 55*b* in an axial direction, having circular sealing protrusions (flexible engaging portions) or lips 55*a* around its periphery. In FIG. 6, reference sign C denotes a center line of the introduction opening 53 into which the sealing member 55 is fitted.

As shown in FIG. 7, the tubular portion 52 of the cable introduction cover 50 has, at the introduction opening 53, a double-pipe structure of a fore and aft short length in which a distal end portion of the tubular portion 52 is bent inward. An inner peripheral surface of the introduction opening 53 is formed with an inclined surface 53, having a smaller inside diameter in a forward direction of the outboard motor and having a larger inside diameter in a rearward direction.

The sealing member 55 has the circular lip portions or lips 55*a* constituting flexible engaging and sealing portions around its periphery, and has a circular flange or collar 55*c* at its rearward portion. A front surface of the circular collar 55*c* abuts on a rear end 53*b* of the introduction opening 53.

Distal end portions 55*b* of the lips 55*a* are bent to closely contact the inclined surface 53*a* of the introduction opening 53 as shown in FIG. 7, providing high sealing performance.

The sealing member 55 is fitted into the introduction opening 53 of the cable introduction cover 50, and the cables 56 and pipes are inserted through the through holes 55*b* in the sealing member 55.

The sealing member 55 is supported by the semicircular support depression 43*a* formed in the arm 43 of the cable holder 41 fixed in advance to the engine 2, and the cables 56 are fixed to the cable holder 41 by a retaining or keep plate 44.

Then, the cable introduction cover 50 is placed from the front and fastened in a given manner, providing a first seal between the inner peripheral surface of the inclined surface 53*a* of the cable introduction cover 50 and the lips 55*a*, and a second seal by abutment between the rear end 53*b* of the introduction opening 53 and the collar 55*c* of the sealing member 55. High sealing performance can thus be easily obtained.

A lower half portion of a rear half portion of the sealing member 55 is supported on the support depression 43*a* formed in the arm 43 of the cable holder 41, and the keep plate 44 (see also FIG. 3) is connected to the connected portion 43*b* at the distal end portion of the arm 43, thereby to secure the retention of the sealing member 55.

Obviously, various minor changes and modifications of the present invention are possible in the light of the above teaching. It is therefore to be understood that within the scope of the appended claims the invention may be practiced otherwise than as specifically described.

What is claimed is:

1. An outboard motor comprising:

an engine;

a cover structure defining at least part of an engine compartment accommodating therein at least a portion of the engine, the cover structure having first and second cover members detachably connected to one another;

a cable introduction cover mounted on the cover structure, the cable introduction cover having a tubular portion provided with an introduction opening through which cables and pipes are introduced into the engine compartment and which opens in a forward direction of the outboard motor, the tubular portion having an inclined inner peripheral surface which decreases in diameter in the forward direction of the outboard motor; and a sealing member mounted in the introduction opening of the cable introduction cover for retaining the introduced cables and pipes in a sealed state, the sealing member having an outer peripheral surface and a circular flexible engaging portion defining a lip extending from the outer peripheral surface, the lip having a distal end portion which is bent to closely contact the inclined inner peripheral surface of the tubular portion of the cable introduction cover to provide a seal between the outer peripheral surface of the sealing member and the inclined inner peripheral surface of the tubular portion.

2. An outboard motor according to claim 1; wherein the cable introduction cover is connected directly to one of the first and second cover members of the cover structure.

3. An outboard motor according to claim 1; further comprising a holding member connected to the cable introduction cover and to the first and second cover members of the cover structure for supporting the cables and pipes introduced into the introduction opening of the cable introduction cover.

4. An outboard motor according to claim 3; wherein the holding member has an arm for supporting the sealing member.

5. An outboard motor according to claim 3; further comprising a retaining plate for integrally connecting the cables and pipes to the holding member.

6. An outboard motor according to claim 1; wherein the sealing member has a collar portion extending from the outer peripheral surface thereof; and wherein the tubular portion of the cable introduction cover has a distal end portion contacting the collar portion of the sealing member to form a hermetic seal therebetween.

7. An outboard motor comprising:

an engine;

a cover structure defining at least part of an engine compartment accommodating therein at least a portion of the engine, the cover structure having first and second cover members detachably connected to one another;

a cable introduction cover connected to the cover structure, the cable introduction cover having a tubular portion provided with an introduction opening through which cables and pipes are introduced into the engine compartment, the tubular portion having a distal end portion bent axially inward into the tubular portion to form the introduction opening; and a sealing member mounted in the introduction opening of the cable introduction cover for retaining the introduced cables and pipes in a sealed state, the sealing member having an outer peripheral surface, a plurality of elastic annular lip portions extending from the outer peripheral surface and disposed in contact with an inner surface of the bent distal end portion of the cable introduction cover to form a hermetic seal therebetween, and an annular flange extending from the outer peripheral surface and disposed in contact with an inner end of the bent distal end portion of the cable introduction cover to form a hermetic seal therebetween.

8. An outboard motor according to claim 7; wherein the cable introduction cover is connected directly to one of the first and second cover members of the cover structure.

9. An outboard motor according to claim 7; further comprising a holding member connected to the cable introduction cover and to the first and second cover members of the cover structure for supporting the cables and pipes introduced into the introduction opening of the cable introduction cover.

10. An outboard motor according to claim 9; wherein the holding member has an arm for supporting the sealing member.

11. An outboard motor according to claim 9; further comprising a retaining plate for integrally connecting the cables and pipes to the holding member.

12. An outboard motor comprising:

an engine;

a cover structure comprised of first and second cover members detachably connected to one another to define at least part of an engine compartment accommodating therein at least a portion of the engine;

a cover body mounted on the cover structure and having a tubular portion with an open end through which cables are introduced into the engine compartment; and a sealing member extending into the tubular portion of the cover body through the open end for retaining in a sealed state the cables introduced into the engine compartment, the sealing member having an outer peripheral surface and a plurality of elastically deformable lip portions extending from the outer peripheral surface and contacting an inner peripheral surface of the tubular portion in the region of the open end to form a hermetic seal between the lip portions and the inner peripheral surface of the tubular portion.

13. An outboard motor according to claim 12; wherein the cover body is connected directly to one of the first and second cover members of the cover structure.

14. An outboard motor according to claim 12; further comprising a holding member connected to the cover body and to the first and second cover members of the cover structure for supporting the cables introduced into the open end of the tubular portion of the cover body.

15. An outboard motor according to claim 14; wherein the holding member has an arm for supporting the sealing member.

16. An outboard motor according to claim 14; further comprising a retaining plate for integrally connecting the cables to the holding member.

17. An outboard motor according to claim 12; wherein the tubular portion of the cover body has a distal end portion bent axially inward into the tubular portion to form the open end; and wherein the inner peripheral surface of the tubular portion comprises an inner surface of the bent distal end portion thereof.

18. An outboard motor according to claim 17; wherein the sealing member has an annular flange extending from the outer peripheral surface and disposed in contact with an inner end of the bent distal end portion of the cover body to form a hermetic seal therebetween.

19. An outboard motor according to claim 12; wherein the sealing member comprises a cylindrical-shaped body having the outer peripheral surface.

20. An outboard motor according to claim 19; wherein the body of the sealing member has a plurality of axial through-holes for retaining the cables in a sealed state.

* * * * *